United States Patent [19]

Grome et al.

[11] Patent Number: 5,020,189

[45] Date of Patent: Jun. 4, 1991

[54] DOOR CLOSURE MECHANISM

[75] Inventors: Donald C. Grome, Edmonds, Wash.; Kurt H. Lundstedt, Long Grove; William Olson, Barrington, both of Ill.

[73] Assignee: Illinois Tool Works Inc., Glenview, Ill.

[21] Appl. No.: 514,929

[22] Filed: Apr. 16, 1990

[51] Int. Cl.[5] ..... E05F 1/08

[52] U.S. Cl. ..... 16/286; 16/72; 16/DIG. 13; 16/DIG. 36; 16/DIG. 10; 267/166

[58] Field of Search ..... 16/49, 50, 70, 72, 286, 16/298, 304, DIG. 23, DIG. 36, DIG. 10, DIG. 13; 267/166, 169, 177

[56] References Cited

U.S. PATENT DOCUMENTS

| | | | |
|---|---|---|---|
| 1,771,299 | 7/1930 | Justus | 16/72 |
| 2,041,914 | 5/1936 | Ferrin | 16/72 |
| 2,207,128 | 7/1940 | Lasier | 16/49 |
| 2,657,420 | 11/1953 | Carbary | 16/72 |
| 3,452,387 | 7/1969 | Jerila et al. | 16/72 |
| 4,030,161 | 6/1977 | Loikitz | 16/297 |
| 4,905,574 | 3/1990 | Trevisan | 267/169 |

FOREIGN PATENT DOCUMENTS

| | | | |
|---|---|---|---|
| 239446 | 9/1986 | German Democratic Rep. | 267/169 |

*Primary Examiner*—Richard K. Seidel
*Assistant Examiner*—Edward A. Brown
*Attorney, Agent, or Firm*—Schwartz & Weinrieb

[57] ABSTRACT

A door closure mechanism for use upon a door of a cabinet includes a housing formed from two co-mating first and second members, a drive cam rotatably mounted within the housing, a cam follower mounted within the housing for reciprocating movement relative to the drive cam, and a coil spring mounted within the housing for resiliently biasing the cam follower in a reciprocal manner against the drive cam. The drive cam is formed with cam surfaces which radially engage the cam follower so as to control the relative reciprocal movement of the cam follower with respect to the drive cam. As a safety feature, ther is provided a set of spring pre-load clips which engage the ends of the coil spring so as to prevent full decompression of the coil spring in the event of a housing failure.

20 Claims, 3 Drawing Sheets

DOOR CLOSURE MECHANISM

FIELD OF THE INVENTION

This invention relates generally to door closure mechanisms and more particularly, it relates to an improved door closure mechanism for use upon a door of a cabinet or other enclosure, such as, for example, a refrigerator or freezer, which includes a set of spring pre-load clips so as to prevent full decompression of a coil spring in the event of a housing failure.

BACKGROUND OF THE INVENTION

A prior art search directed toward the subject matter of this application was conducted in the U.S. Patent and Trademark Office and revealed the following patents:

U.S. Pat. Nos. 1,852,863; 2,207,128; 3,452,387; 3,518,719; and 4,030,161.

In U S. Pat. No. 3,452,387 issued on July 1, 1969, to T. Jerila et al., there is disclosed a closing device for hingedly mounted doors which includes a mounting bracket having a pair of sideplates with aligned ends, a cam member journaled between the sideplate ends, and a cam follower mounted between the sideplate ends and being radially movable relative to the cam member. A slidable tie bracket is retained between the sideplates means of a pin-slot connector arrangement and mounts the cam follower which is resiliently urged towards and rolls over a peripheral cam surface of the cam member by means of a coil compression spring. The cam member is symmetrical and has a door closed depression, a diametrically opposed door stop projection, and intermediate door opening surfaces defined therebetween. The mounting bracket is connected to the door and the cam member is connected to a cabinet by means of a coaxially received pin.

However, none of the prior art patents discloses a safety feature wherein a set of spring pre-load clips is provided so as to prevent full decompression of the coil spring in the event of a housing failure. It would therefore be desirable to provide an improved door closure mechanism for use upon a door of a cabinet which includes a set of pre-load clips so as to prevent full decompression of a coil spring in the event of a housing failure. The present invention therefore represents an improvement over the above-described '387 patent.

OBJECTS OF THE INVENTION

Accordingly, it is a general object of the present invention to provide an improved door closure mechanism which is relatively simple and economical to manufacture and assemble, but additionally provides a safety feature not found heretofore in the prior art door closing devices.

It is an object of the present invention to provide an improved door closure mechanism for use upon a door of a cabinet which includes a set of spring pre-load clips so as to prevent full decompression of a coil spring in the event of a housing failure.

It is another object of the present invention to provide an improved door closure mechanism which is versatile and interchangeable, with the same closure mechanism being readily usable with both right-handed and left-handed opening doors of a side-by-side type refrigerator.

It is still another object of the present invention to provide an improved door closure mechanism which includes a housing formed of two co-mating symmetrical front and back members which can be easily, assembled with a drive cam, a cam follower, a coil compression spring, and a set of spring pre-load clips therein and then welded together so as to complete the assembly thereof.

SUMMARY OF THE INVENTION

In accordance with these aims and objectives, the present invention is concerned with the provision of an improved door closure mechanism for use upon a door of a cabinet which includes a housing, a drive cam, a cam follower, a coil compression spring, and a set of spring pre-load clips. The housing is formed from two co-mating symmetrical front and back members which are joined together by means of sonic welding. The drive cam is rotatably mounted within the housing. The cam follower is also mounted within the housing for reciprocating movement relative to the drive cam. The coil spring is mounted within the housing for resiliently urging the cam follower in a reciprocal manner against the drive cam. The drive cam is provided with cam surfaces which radially engage the cam follower so as to control the relative reciprocal movement of the cam follower with respect to the drive cam. The spring preload clips engage the ends of the coil spring so as to limit the full extension of the coil spring upon decompression.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, and wherein.

DESCRIPTION OF THE PREFERRED EMBODIMENT

Figure 1:
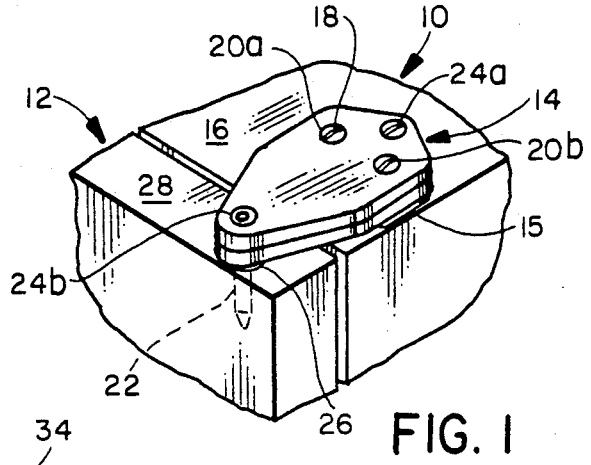
FIG. 1 is a fragmentary, perspective view of an appliance utilizing a door closure mechanism, constructed in accordance with the principles of the present invention.

Referring now in detail to FIGS. 1–4 of the drawings, there is illustrated an appliance having a cabinet 10 and a door 12. The cabinet 10 may be an enclosure for a refrigerator or freezer and the door may be a refrigerator door or freezer door. A door closer mechanism 14 constructed in accordance with the principles of the present invention is mounted externally by means of a spacer 15 to an upper surface 16 of the cabinet 10 by means of a plurality of fastening members 18 such as, for example screws inserted downwardly through corresponding openings 20*a*, 20*b* and 24*a*. A removable metal hinge pin 22 is extended through an end opening 24*b* defined within the closure mechanism 14 and into an aperture 26 formed within the upper surface 28 of the door 12. In this manner, the closure of mechanism 14 is utilized for controlling the hinged movement of the door 12 relative to the cabinet 10.

The door closure mechanism 14 includes a molded plastic housing made of suitable materials and is comprised of two co-mating front and back halves or members 32 and 34. The two halves are of symmetrical design and are ultimately joined together such as, for example, by means of sonic welding. The housing has a generally elliptical shape and includes a pair of end openings 24*a* and 24*b*. Disposed upon each side of the end opening 24*a*, there are provided a pair of side openings 20*a*, 20*b*. The front and back halves 32 and 34 are provided with outer confronting wall members 36 and 38, respectively.

Since the two halves 32 and 34 are identical in their construction, it will be sufficient to, describe the structure of only one of the two halves. As can best be seen from FIG. 2, the wall member 38 of the back half 34 is recessed at 40 so as to receive and enclose a drive cam 42, a cam follower 44, a coil compression spring 46, and a set of identical spring pre-load clips 48*a* and 48*b*. A pair of parallel spaced-apart strut members 50 and 52 extend longitudinally between the end openings 24*a* and 24*b* so as to define a channel 54 therebetween.

One end of the channel 54 adjacent the end opening 24*a* is terminated means of an L-shaped platform 56. At the other end of the channel adjacent the end opening 24*b*, there are provided a pair of inwardly extending flanges 58 and 60 which are integral with the respective strut members 50 and 52. In a substantially intermediate area of the strut members between the flanges and the platform, there are formed a pair of outwardly extending shoulder portions 62 and 64. The shoulder portions 62 and 64 are arranged in a spaced apart relationship and are aligned relative to the respective flanges 58 and 60 so as to define a compartment 66. It will be noted that the flanges 58, 60 and the interior surface of the wall member 38 also define another compartment 68.

The drive cam 42 is formed with an arcuate, radially extending depression or depressed surface 70, diametrically opposite radially outwardly extending projections 72 having a slight intermediate depression 74, and generally circumferential surface sections 76 extending at opposite sides between the depressed surface 70 and the projection 72. The depressed surface 70 is substantially diametrically opposite the projections 72, and the opposite circumferential surface sections 76 are substantially diametrically disposed.

When the two halves 32 and 34 are brought together in an assembled position, the end openings 24*b* defined within the compartment 68 receive and journal or rotatably mount the opposite axially depending, cylindrical hub portion 80 of the drive cam 42 extending therethrough. The circumferential surface sections 76 of the drive cam 42 are positioned so as to be opposite the interior surfaces of the wall members 36 and 38. The drive cam 42 is formed coaxially with an axially extending engagement opening 82 defined within the hub portion 80. There are provided diametrically opposed slots 84 in communication with the opening 82. The engagement opening 82 slidably receives the hinge pin 22.

The hinge pin 22 is provided with diametrically opposed fins 86 which are engageable within the slots 84 of the opening 82 of the hub portion 80. As a result, the drive cam 42 and the hinge pin 22 are fixed against relative rotation. The hinge pin 22 is formed with a collar 88 which rests upon the upper surface 28 of the door 12 while the lower part of the pin extends into the door. As previously stated, the door closure mechanism 14 overlies the upper surface 16 of the cabinet 10 by means of the spacer 15 and is secured thereto by means of screws received within the openings 20*a*, 20*b* and 24*a*.

The cam follower 44 has a hollow square-shaped middle portion 90, a lower portion 92 formed integrally with the middle portion, and a semi-cylindrical top or head portion 94 also formed integrally with the middle portion. The lower portion 92 includes a pair of downwardly depending spaced-apart leg members 96 which are slidably received within the compartment 66 defined between the flanges 58, 60 and the shoulder portions 62, 64. The head portion 94 has an arcuate surface 98 which faces the depression 70 of the drive cam 42 and is also received within the compartment 68.

The coil compression spring 46 is received within the channel 54 and the compartment 66 so as to be interposed between the bottom surface of the lower portion 92 of the cam follower 44 and the L-shaped platform 56. The compression spring 46 will thus at all times resiliently urge the arcuate surface 98 of the cam follower 44 towards the depression or depressed surface 70 of the drive cam 42. While the door closure mechanism 14 thus far described is capable of controlling the hinged movement of the door 12, this functioning of the structure alone is not completely satisfactory under all circumstances from a safety standpoint. In particular, in the event of a housing failure a consumer would not be protected from the sudden full decompression of the coil spring 46.

Figure 2:
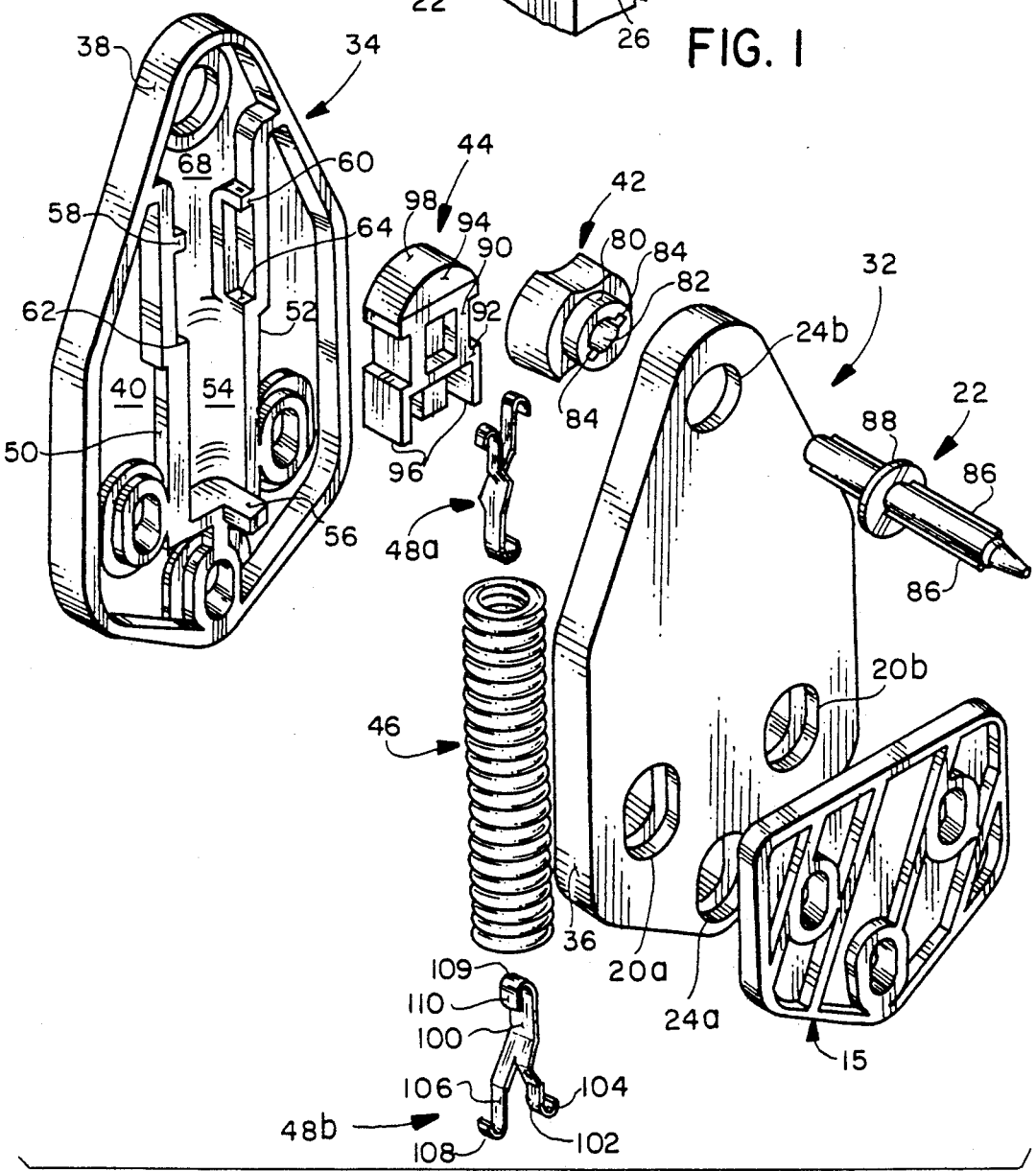
FIG. 2 is an exploded view of the door closure mechanism of the present invention, being removed from the appliance of FIG. 1 so as to better illustrate the various components thereof.

In order to avoid this problem, there is provided in accordance with the present invention the set of spring pre-load clips 48*a*, 48*b* which engage each end of the coil spring 46 so as to limit or prevent full decompression of the coil spring so that by means of the clips 48*a*, 48*b*, full extension of the coil spring will not occur upon the failure of the housing, thereby protecting the consumer against a dangerous situation. The set of clips 48*a*, 48*b* shown in FIG. 2 are identical and one of them is shown in full detail in FIGS. 6–9. The spring pre-load clip 48*b* has a generally Y-shaped configuration and includes a flat body portion 100 having a single narrow leg 102 extending therefrom in a substantially co-planar relation and terminating in a hooked portion 104. A narrow leg 106 also extends from the body portion 100 in an upwardly direction and terminates in a hooked portion 108. At the opposite end of the flat body portion 100, there is provided a flat head portion 109 having an integral reversely bent depending projection 110.

Figure 3:
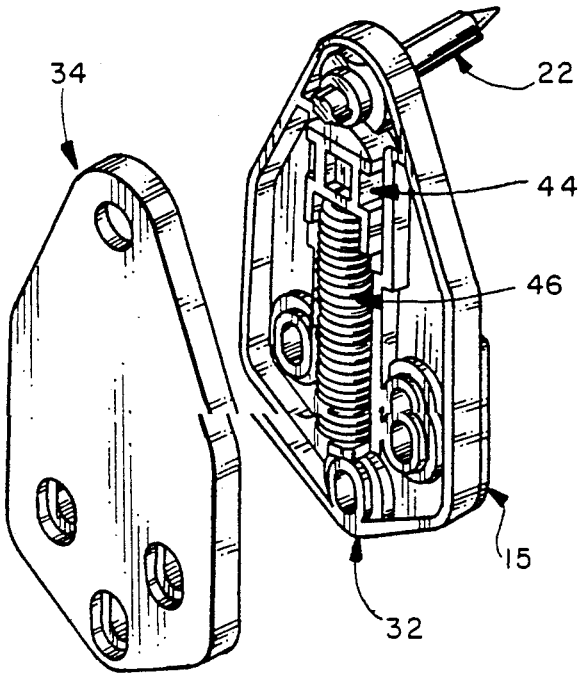
FIG. 3 is a perspective view of the door closure mechanism of the present invention in its partly assembled condition.
Figure 4:
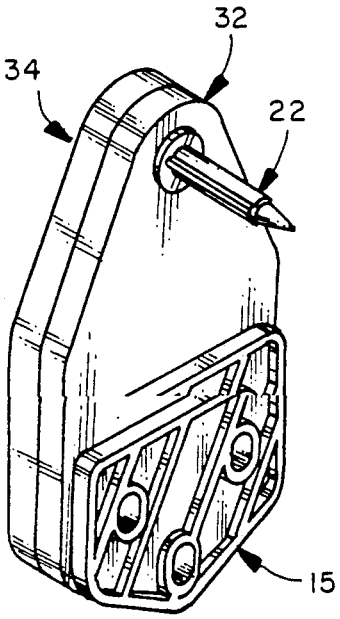
FIG. 4 is a perspective view of the door closure mechanism of the present invention in its fully assembled condition.

In assembly, the set of spring pre-load clips 48*a* and 48*b* are inserted into the ends of the coil spring 46. As will be noted, the flat head portions 109 are inserted into the core of the spring while the hooked portions 104, 108 engage the peripheral edges of the spring. Furthermore, the reversely bent projections 110 of the corresponding clips 48*a*, 48*b* are adapted to be interengaged with each other so as to limit the maximum extension of the spring. Thus, it should be apparent that the hooked portions 104, 108 of the corresponding clips are retained between the bottom surface of the lower portion 92 of the cam follower 44 and the L-shaped platform 56 when the cam follower is inserted into the compartments 66 and 68, thereby facilitating easy and quick assembly thereof. Then, the drive cam 42 is also placed into the compartment 68, as shown in FIG. 3. Finally, the two halves are brought together so as to sandwich all of the components therebetween. A sonic welding process is used to fixedly secure the two halves of the housing together. As a result, the finished door closure mechanism of FIG. 4 is formed.

The operation of the door closure mechanism 14 will now be described with reference to FIGS. 5 and 6 of the drawings. For purposes of completeness, reference is made to the '387 patent which describes the basic opening and closing operations and positions of the cam and the cam follower which are quite similar to those of the present invention. When the door 12 is in the closed position relative to the cabinet 10, the arcuate surface 98 of the cam follower 44 of the present invention is disposed substantially entirely within the depressed surface 70 of the drive cam 42 as can best be seen from FIG. 5. It can be seen that the hooked portions 104, 106 of the clips are interengaged or locked with the peripheral ends of the coil spring and the corresponding reversely bent portions 109 of the clips are also interlocked so as to present a predetermined pre-load condition. This has an advantage in that the assembly of the closure mechanism is facilitated.

Upon the door 12 being selectively moved toward an open position, the drive cam 42 is rotated in a counterclockwise direction so that the circumferential surface section 76 engages the arcuate surface 98 of the cam follower 44 whereby the latter moves axially against the resilient mounting of the coil spring 46. During such movement, the drive cam 42 rotates relative to the cam follower 44 and the cam follower reciprocates within the compartments 66 and 68 so as to cause compression of the coil spring 46, as illustrated in FIG. 6. It will be noted that the projections 109 of the clips are out-of-engagement with respect to each other.

Figure 5:
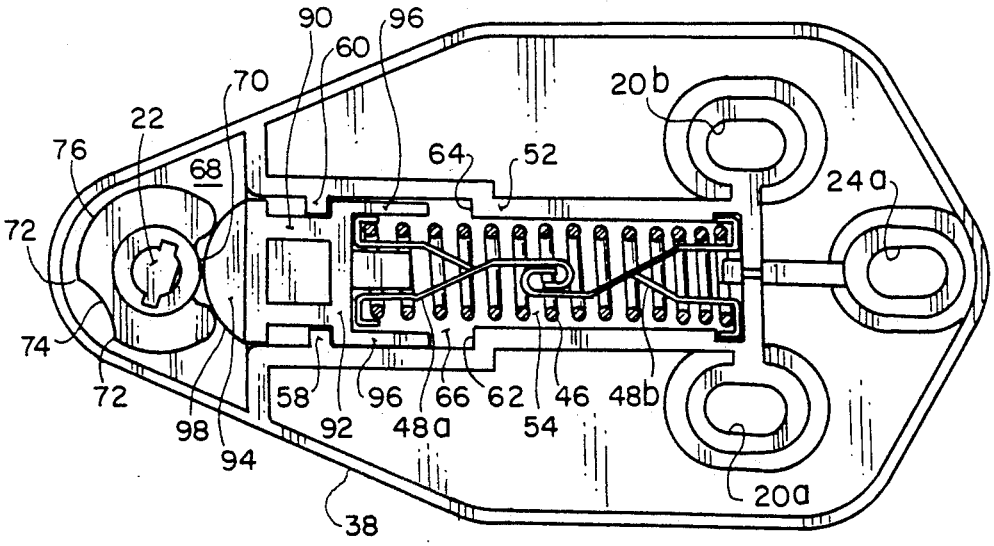
FIG. 5 is an elevational view of the door closure mechanism of the present invention when the door is in a closed position.
Figure 6:
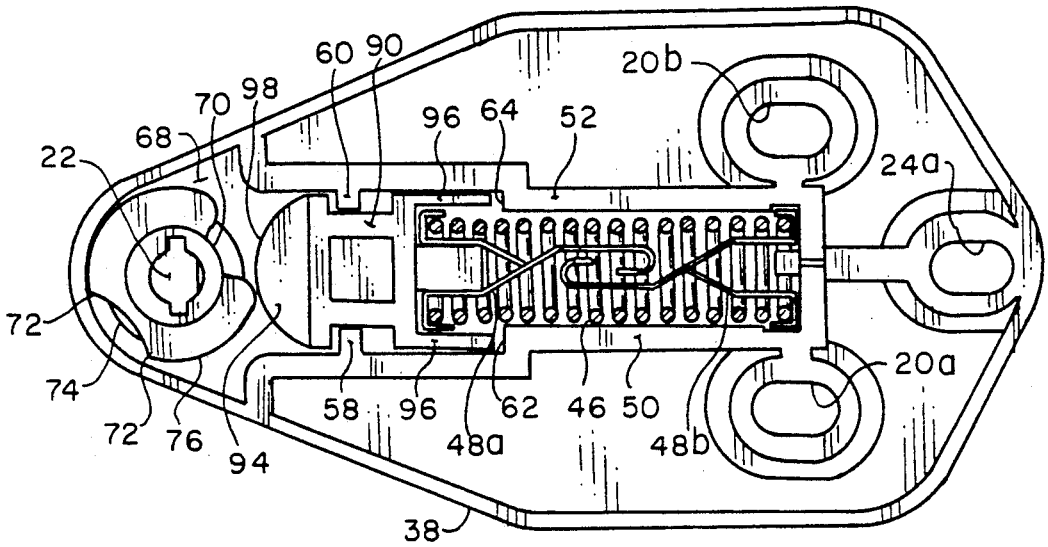
FIG. 6 is a view similar to FIG. 5, but when the door is swung to an open position.
Figure 7:
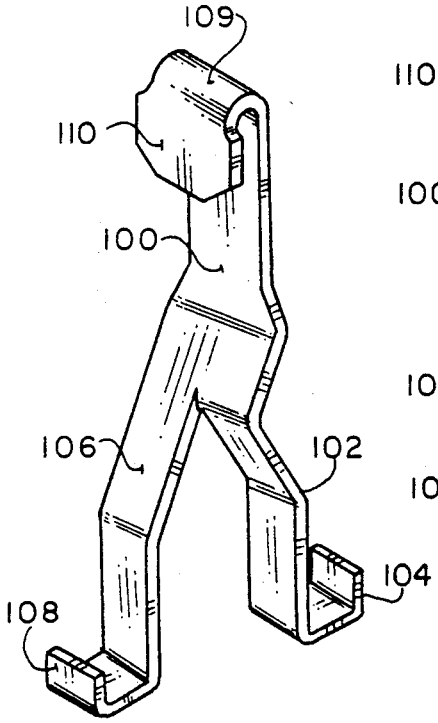
FIGS. 7–9 are enlarged views of one of the spring pre-load clips, constructed according to the present invention.
Figure 8:
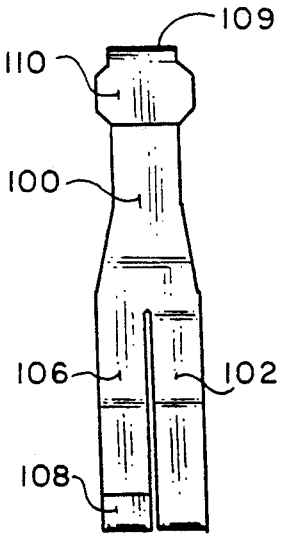
Figure 9:
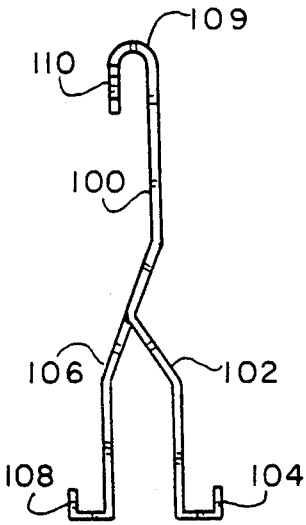
Figure 10:
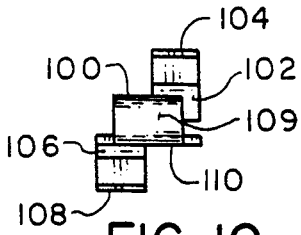

The safety feature of the door closure mechanism 14 of the present invention is provided by the fact that in the event of a housing failure full decompression of the coil spring 46 will be prevented by means of the interengagement of the corresponding projections 109 provided upon the clips 48*a*, 48*b* so as to retain the coil spring 46 in the predetermined preload condition, as depicted in FIG. 5. In particular, upon such a decompression of the spring 46, the corresponding projections 109 of the clips would be interlocked, and the extension of the spring would be limited by means of the hooked portions 104, 106 engaging the respective ends of the spring. It can thus be seen that a hazardous condition to the consumer has been avoided.

During the closing of the door 12, the rotation of the drive cam 42 and the reciprocation of the cam follower 44 are, of course, just the opposite to those operations or movements characteristic of when the door is opened. As the depressed surface 70 of the drive cam 42 rolls into engagement with the arcuate surface 98 of the cam follower 44, the door 12 will be immediately urged back into its fully closed position due to the decompression of coil spring 46.

In order to mount the door closure mechanism 14 of the present invention for a left-handed opening door opposite to that shown in FIG. 1, it is only necessary to invert the closure mechanism and mount the same at the opposite side of the cabinet 10 by means of screws through the same openings 20*a*, 20*b* and 24*a*. Then, the hinge pin 22 would be axially received within into the cam opening 82 from the opposite side of the drive cam 42 and inserted into the door. The opening and closing operations for the closure mechanism will be precisely the same due to the symmetrical design of the drive cam 42. As a result, the closure mechanism is completely versatile and interchangeable for either right-handed or left-handed opening doors. In addition, the closure mechanism of the present invention has relatively high strength and is relatively light in weight since all of the components, except for the coil spring 46, spring preload clips 48*a* and 48*b*, and the hinge pin 22, are preferably made from a suitable plastic material.

From the foregoing detailed description, it can thus be seen that the present invention provides an improved door closure mechanism for use upon a door of a cabinet. The door closure mechanism includes a set of spring preload clips so as to prevent full decompression of a coil spring in the event of a housing failure. Furthermore, the door closure mechanism is versatile and interchangeable since the same closure mechanism can be readily usable with both right-handed and left-handed opening side doors of a side-by-side type refrigerator.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt the present invention to a particular situation or to adapt a particular material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A door closure mechanism for use upon a door of a cabinet, comprising in combination:

housing means;

a drive cam rotatably mounted within said housing means;

a cam follower mounted within said housing means for reciprocating movement relative to said housing means in response to rotatable movement of said drive cam;

a coil compression spring mounted within said housing means for resiliently biasing said cam follower reciprocally against said drive cam;

cam surface means formed upon said drive cam and radially engaging said cam follower so as to control the relative movement of said cam follower with respect to said drive cam;

means for connecting said housing means to one of said door and said cabinet, and for connecting said drive cam with the other one of said door and said cabinet; and means, for preventing full decompression of said coil compression spring in the event of a housing failure, comprising a pair of single-piece identical clips, one end of each of said clips having first hook means for engaging a peripheral end portion of said coil spring, and a second end of each of said clips having second hook means for permitting disengagement between said clips with respect to each other when said compression coil spring undergoes a predetermined amount of axial compression so as to permit said compression coil spring to undergo said axial compression, and for permitting engagement between said clips with respect to each other when said compression coil spring undergoes a predetermined amount of axial expansion so as to prevent said full decompression of said coil compression spring in the event of said housing failure.

2. A door closure mechanism as claimed in claim 1, wherein said housing means is comprised of two co-mating symmetrical front and back members.

3. A door closure mechanism as claimed in claim 2, wherein said front and back members are made of a suitable plastic material and are joined together by sonic welding.

4. A door closure mechanism as claimed in claim 1, wherein each of said single-piece identical clips is of a generally Y-shape and includes a flat body portion having a first narrow leg extending therefrom in a co-planar relation and terminating in a first hocked portion, a second narrow leg extending from said body portion out of a plane of said first leg and terminating in a second hooked portion, and a head portion extending from another end of said body portion and having a reversely bent projection.

5. A door closure mechanism as claimed in claim 4, wherein one of the pair of clips has its head portion extending into one end of the coil spring with its respective first and second hooked portions engaging a peripheral one of the spring, and wherein another end of the pair of clips has its head portion extending into the other end of the spring with its respective first and second hooked portions engaging the other peripheral end of the spring, said projections on said pair of clips being interengaged so as to lock said spring in a predetermined pre-load condition.

6. A door closure mechanism as claimed in claim 1, wherein said cam follower comprises a hollow square-shaped metal portion, a lower portion, and a semi-cylindrical head portion all being integrally formed together, said head portion having an arcuate surface for engagement with said cam surface means.

7. A door closure mechanism as claimed in claim 1, wherein said drive cam and said cam follower are made of a plastic material.

8. A door closure mechanism as claimed in claim 5, wherein said single-piece identical clips are made of metal.

9. A door closure mechanism for use upon a door of a cabinet, comprising in combination:

housing means formed of two co-mating front and back members;

a drive cam rotatably mounted within said housing means;

a cam follower mounted within said housing means for undergoing reciprocating movement relative to said housing means in response to rotatable movement of said drive cam;

a coil compression spring mounted within said housing means for resiliently biasing said cam follower reciprocally against said drive cam;

cam surface means formed upon said drive cam for radially engaging said cam follower so as to control the relative movement of said cam follower with respect to said drive cam;

means for connecting said housing means with one of said door and said cabinet, and for connecting said drive cam with the other one of said door and said cabinet; and clip means, engaging the ends of said coil spring for limiting the full extension of said coil spring upon decompression thereof, comprising a pair of single-piece identical clips, one end of each of said clips having first hook means for engaging a peripheral end portion of said coil spring, and a second end of each of said clips having second hook means for permitting disengagement between said clips with respect to each other when said compression coil spring undergoes a predetermined amount of axial compression so as to permit said compression coil spring to undergo said axial compression, and for permitting engagement between said clips with respect to each other when said compression coil spring undergoes a predetermined amount of axial expansion so as to limit said full extension of said coil spring under decompression conditions.

10. A door closure mechanism as claimed in claim 9, wherein each of said single-piece identical clips is of a generally Y-shape and includes a flat body portion having a first narrow leg extending therefrom in a co-planar relation and terminating in a first hooked portion, a second narrow leg extending from said body portion out of a plane of said first leg and terminating in a second hooked portion, and a head portion extending from another end of said body portion and having a reversely bent projection.

11. A door closure mechanism as claimed in claim 10, wherein one of said pair of clips has its head portion extending into one end of the coil spring with its respective first and second hooked portions engaging a peripheral one of the spring, and wherein another end of said pair of clips has its head portion extending into the other end of the spring with its respective first and second hooked portions engaging the other peripheral end of the spring, said projections on said pair of clips being interengaged so as to lock said spring in a predetermined pre-load condition.

12. A door closure mechanism as claimed in claim 9, wherein said cam follower comprises a hollow square-shaped metal portion, a lower portion, and a semi-cylindrical head portion all being integrally formed together, said head portion having an arcuate surface for engagement with said cam surface means.

13. A door closure mechanism as claimed in claim 9, wherein said drive cam and said cam follower are made of a plastic material.

14. A door closure mechanism as claimed in claim 11, wherein said pair of single-piece identical clips are made of metal.

15. A door closure mechanism for use upon a door of a cabinet, comprising in combination:

housing means;

drive cam means rotatably mounted within said housing means;

cam follower means mounted within said housing means for undergoing reciprocating movement relative to said housing means in response to rotatable movement of said drive cam means;

resilient means mounted within said housing means for resiliently biasing said cam follower means reciprocally against said drive cam means;

cam surface means formed upon said drive cam means for radially engaging said cam follower means so as to control the relative movement of said cam follower means with respect to said drive cam means;

means for connecting said housing means with one of said door and said cabinet, and for connecting said drive cam means with the other one of said door and said cabinet; and means, for preventing full decompression of said resilient means in the event of a housing failure, comprising a pair of single-piece identical clips, one end of each of said clips having first hook means for engaging a peripheral end portion of said resilient means, and a second end of each of said clips having second hook means for permitting disengagement between said clips with respect to each other when said resilient means undergoes a predetermined amount of axial compression so as to permit said resilient means to undergo said axial compression, and for permitting engagement between said clips with respect to each other when said resilient means undergoes a predetermined amount of axial expansion so as to prevent said full decompression of said resilient means in the event of said housing failure.

16. A door closure mechanism as set forth in claim 15, wherein:

said resilient means comprises a coil compression spring.

17. A door closure mechanism as set forth in claim 15, wherein:

each of said identical clips has a substantially Y-shaped configuration having three legs, two of said three legs being provided at said one end of each of said clips and comprising said first hook means, and a third one of said three legs being provided at said second end of each of said clips and comprising said second hook means.

18. A door closure mechanism as set forth in claim 15, wherein:

said housing mean comprises two co-mating symmetrical front and back members fabricated from a plastic material.

19. A door closure mechanism as set forth in claim 15, wherein:

said identical clips are fabricated from metal.

20. A door closure mechanism as set forth in claim 15, wherein:

said cabinet comprises a refrigerator.

* * * * *